United States Patent [19]

Mahaffy et al.

[11] 4,114,348

[45] Sep. 19, 1978

[54] PACKAGING TECHNIQUES FOR SEMI-RIGID PACKAGES

[75] Inventors: Reid A. Mahaffy, Montclair; Joel A. Hamilton, Englewood, both of N.J.

[73] Assignee: Mahaffy & Harder Engineering Co., Totowa, N.J.

[21] Appl. No.: 834,429

[22] Filed: Sep. 19, 1977

Related U.S. Application Data

[60] Continuation of Ser. No. 683,256, May 5, 1976, abandoned, which is a division of Ser. No. 384,717, Aug. 1, 1973, Pat. No. 3,972,155, which is a division of Ser. No. 860,590, Sep. 24, 1969, Pat. No. 3,792,181.

[51] Int. Cl.[2] ..... B65B 31/02

[52] U.S. Cl. ..... 53/433; 53/510; 53/511

[58] Field of Search ..... 53/22 R, 22 A, 112 R, 53/112 A

[56] References Cited

U.S. PATENT DOCUMENTS 3,481,101 12/1969 Steadman ..... 53/22 A

FOREIGN PATENT DOCUMENTS 766,598 9/1967 Canada ..... 53/22 A

*Primary Examiner*—Travis S. McGehee

*Attorney, Agent, or Firm*—Parmelee, Johnson, Bollinger & Bramblett

[57] ABSTRACT

A package comprising a receptacle cup of semi-rigid plastic having a top of semi-rigid plastic sealed to flanges of the receptacle and formed inwardly to press against the packaged product and hold it in place with or without evacuation of the interior. Different techniques and apparatus are disclosed for forming such packages. Package configurations also are disclosed providing improved recloseable characteristics, wherein the semi-rigid nature of both the top and the cup are utilized to enable the reclosed top to be held securely in place.

19 Claims, 14 Drawing Figures

PACKAGING TECHNIQUES FOR SEMI-RIGID PACKAGES

This is a continuation, of application Ser. No. 683,256 filed May 5, 1976, now abandoned, which in turn is a division of Ser. No. 384,717 filed Aug. 1, 1973, now U.S. Pat. No. 3,972,155, which in turn is a division of Ser. No. 860,590 filed Sept. 24, 1969 now U.S. Pat. No. 3,792,181.

This invention relates to the packaging of food products and the like in plastic containers. More particularly this invention relates to (1) automatic apparatus for making packages from continuous webs of plastic sheet material, supplied in the form of roll stock, (2) packaging methods carried out by such apparatus, and (3) improved package constructions especially adapted to be formed by automatic apparatus.

For a number of years now, use has been made of various types of automatic apparatus for packaging food products. The automatic roll-stock machines have been particularly successful, and have gone into widespread use. Such machines, as shown for example in U.S. Pat. No. 3,061,984, are adapted to package products, such as sliced luncheon meat and frankfurters, in containers made from two continuous webs or sheets of thin flexible plastic film.

In such machines, one web is stretch-formed into the shape of a cup for the product, and the other web is applied in flat (unformed) state over the cup to serve as a top for the package. The top web is hermetically sealed to the cup periphery and the package interior evacuated. After evacuation is complete, atmospheric pressure forces both the top and bottom webs inwardly into tight fitting contact with the product, thus distorting both the container cup and its top into shape conforming to the product profile.

An improvement on this type of package was made by substituting a heavy-gauge (10 mil PVC or heavier) plastic web for the formed flexible plastic web described above, thereby producing a semi-rigid container shell better adapted to retain its shape. A significant further improvement was made by stretch-forming the flexible top web in such a way as to prevent the top film from transmitting distorting stresses to the semi-rigid formed shell after evacuation, thus avoiding the tendency of such shells to be collapsed by atmospheric pressure. A discussion of this problem and suitable corrective techniques is set forth in co-pending Application Ser. No. 484,249, filed on September 1, 1965, by W. E. Young and R. A. Mahaffy.

As explained in that co-pending application, stretch-forming of the flexible top can be effected by preheating the top web in an operating station preceding the evacuation station, and forming the top web at the evacuation station, i.e. during the evacuation and vent cycle. Some of the advantages of a package made by using such techniques are: (1) The bottom surface of the package is smoother (less wrinkled) than in prior packages made entirely from flexible film, and thus the bottom of the package is adapted to serve as a display face for presenting the product to a customer; (2) the package can more readily be opened, since the packaging materials are more easily peeled apart; (3) the semi-rigid cup provides better storage of unused portions of the original contents; and (4) a group of such packages can readily be stacked since the face of one package nests within the recessed back to the next.

Although packages of the semi-rigid cup type have furnished very important benefits, it has been found that certain new features can provide important improvements. For example, as will be explained hereinafter, new techniques make it possible to hold a package product pressed against the display face when the package interior is not evacuated, a feature particularly useful in (1 ) gas-filled packages, (2) vacuum packages which have leaked a small amount, and (3) packages not hermetically sealed. These new techniques also provide a package having even greater overall rigidity than prior semi-rigid cup packages, and make it readily possible to display the product to a customer through the container top, rather than through the bottom of the cup.

The present invention provides a new type of package having these desirable characteristtics, and yet capable of being produced by automatic packaging apparatus operating on continuous webs of plastic sheet supplied as roll stock.

These objectives, as well as other related advantages, have been achieved by packaging techniques in accordance with the present invention. In one preferred embodiment of this invention, to be described hereinbelow in detail, a package is produced having a semi-rigid cup-like container formed from a heavy-gauge plastic sheet (as in prior art packages) heated and formed by conventional vacuum and/or pressure means into a shell which approximates in configuration the profile of the products it is to contain. This shell is covered with a top made of semi-rigid material, rather than flexible film as in the prior art packages described above.

In accordance with one aspect of this invention, it has been determined that such a semi-rigid top can be formed by appropriate techniques from a continuous sheet of roll stock. Preferably, the material for the top has a thickness about the same as, or somewhat less than, that of the associated semi-rigid cup. The top is heat-sealed to the formed shell at least around most of its periphery. Interiorly of the heat-seal area the top also is heated to a plastic condition, and subsequently is forced downwardly towards the semi-rigid cup to conform at least roughly to the shape of the product previously placed in that cup. In one embodiment this downward forming of the plastic top advantageously is effected by atmospheric pressure when the exterior of the package is vented following evacuation. The forming of the heated top down against the product avoids the tendency of the semi-rigid shell of collapse during such venting.

A package constructed in this manner meets the objectives outlined above and, in addition, offers other important benefits in use. For example, when the package is peeled open, there is less chance of tearing the cover sheet. Also, this package lends itself in a unique fashion to special configurations providing a positive reclosure characteristic, i.e. an assured holding of the top in its closed position.

Accordingly, it is an object of this invention to provide improved packaging techniques, including novel means and methods for packaging items such as food products. A more specific object of the invention is to provide improved packages of the semi-rigid type having unique characteristics. Other specific objects of the invention include the creation of improved gas-filled packages, as well as packages having a superior reclosure capability. Still other objects, aspects and advantages of the invention will in part be pointed out in, and in part apparent from, the following description considered together with the accompanying drawings, in which:

Figure 1:
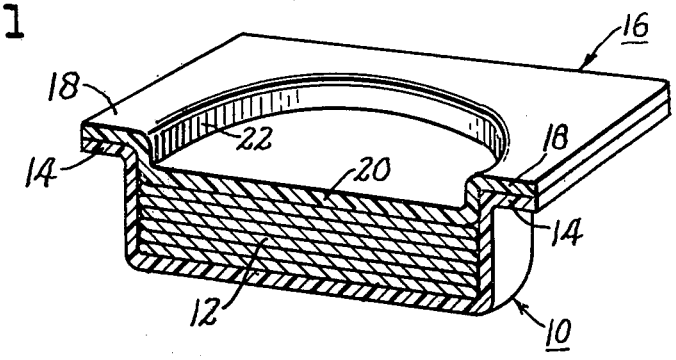
FIG. 1 is a perspctive view, in section, of a package made in accordance with this invention and adapted for use with sliced luncheon meat.

Referring now to FIg. 1, there is shown in sectional perspective a package comprising a round receptacle cup 10 of heavy-gauge plastic. This cup contains product 12 having a circular outline with flat top and bottom surfaces, e.g. a stack of bologna or round luncheon meat. The cup is formed with marginal portions 14 in the plane of the cup mouth, and having a generally rectangular plan configuration. The product has a depth smaller than that of the cup, so that there is a moderate amount of space between the top of the product and the level of marginal portions 14.

The top of the package includes outboard portions 18 with a rectangular plan configuration matching that of the marginal flanges 14 of the cup 10. These top portions 18 are heat-sealed to the cup flanges to hermetically seal the package interior from outside atmosphere thus providing for vacuum packaging. This top is formed of heavy-gauge plastic, providing form-retaining characteristics, and is shaped with a downwardly-offset central portion 20 telescoped within the container cup.

The walls 22 of this concave top 16 are tightly fitted within the cup walls and held pressed thereagainst. The central portion 20 similarly is pressed against the top surface of the product 12, thus advantageously holding the product tightly gripped between the top and bottom of the package. The form-retaining characteristics of the plastic material of both the cup and its top assures that this tight grip of the product will be maintained even without a pressure differential between the inside and the outside of the package.

The materials selected for the package must meet several criteria, some tending to conflict, thus making the selection relatively critical. For example, in order to obtain form-retaining capability, the packaging material must be relatively rigid. However, it must be capable of readily being formed at high speed into various complex shapes by means of heat and pressure. The material also should present a barrier to the passage of oxygen. The physical characteristics of the top material also should include the capability of being heat-sealed to itself, yet easily peeled apart for opening the package. And, as with all packages, the packaging material must be able to withstand the particular environments and handling conditions encountered in usage.

A packaging material which has been found to meet these exacting requirements is a laminate consisting of (1) a first outer layer of PVC with a thickness of 7-½ mils for rigidity, (2) a thin intermediate layer (0.1 mils) of PVDC for oxygen barrier, and (3) a 2 mil inner layer of Surlyn (an ionomeric thermoplastic sold by Dupont) to provide heat sealing and peelable opening. This same material advantageously may be used for making both the semi-rigid cup and the top, although in some cases the gauges of the two webs may be somewhat different. The engaged (heat-sealed) layers of plastic are self-peelable, i.e. the two package components can be peeled apart without requiring stresses sufficient to destroy either component.

Figure 2:
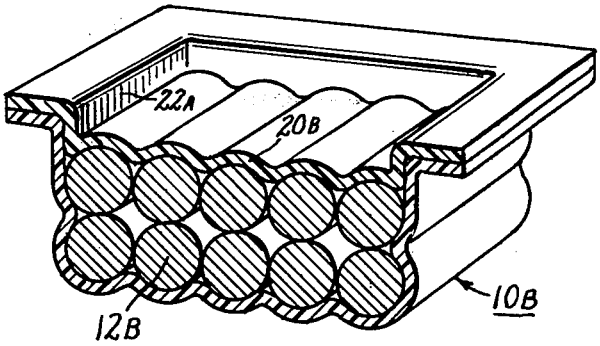
FIG. 2 is another package configuration, showing both the top and bottom webs shaped to fit about a group of frankfurters.

FIG. 2 shows a package in which the cup 10B has a generally rectangular plan outline, and is formed with a bottom and side wall configuration shaped to snugly receive two layers of frankfurters 12B. The central portion 20B of the top also has been formed to fit tightly about the curved upper surfaces of the frankfurters, so as to distribute the pressure load over a relatively broad area of the product.

Figure 3:
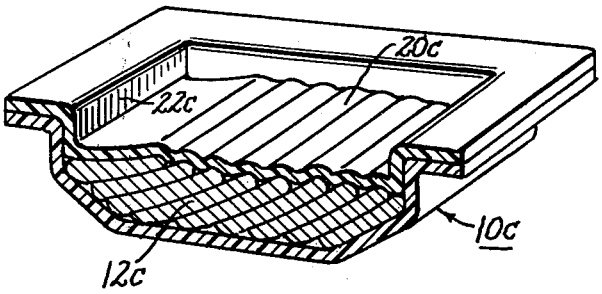
FIG. 3 is another package shaped for sliced bacon.

FIG. 3 shows another package wherein the cup 10C is sepcially shaped to receive sliced bacon 12C, and the top 20C is formed about the upper edges of the bacon slices, to hold the entire group of slices firmly in place with a broadly distributed pressure load.

The packages shown in FIGS. 1–3 can be evacuated and hermetically sealed, a feature of importance in obtaining extended shelf-life of many food products. After evacuation, the packages advantageously may be filled with an inert gas, at or somewhat below atmospheric pressure. In the gas-filled packages of FIGS. 1–3, the form-retaining characteristics of both the top and the receptacle cup assure that the product will be held tightly in position, i.e. immobilized in the package, pressed against the under surface of the top central portion 20. This holding pressure particularly enhances the display characteristics of the package, since many products contain liquids which "wet" the inner surfaces of the package in the areas of contact thus minimizing or eliminating voids and gas bubbles which detract from optimum appearance. This enhancement of appearance applies to both the top and the bottom of the cup.

Figure 4:
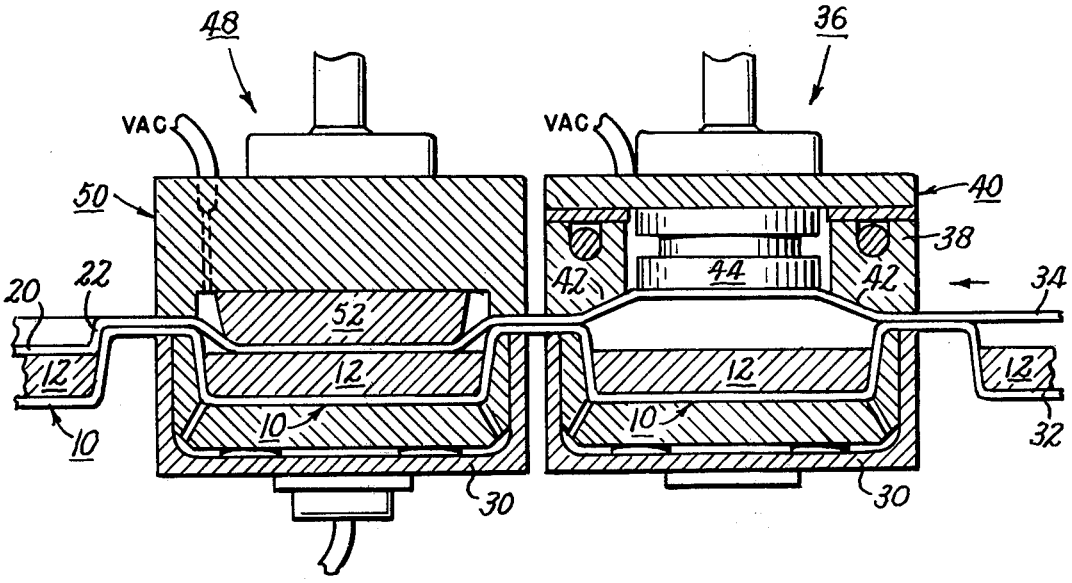
FIG. 4 is a vertical longitudinal section showing a portion of an automatic packaging machine adapted to make packages as shown in FIG. 1.

FIG. 4 shows the pertinent portion of an automatic packaging machine for producing packages of the type shown in FIG. 1. This machine is basically of the type shown in U.S. Pat. No. 3,061,984, comprising a series of traylike dies 30 arranged for intermittent indexing movement around a closed path passing through or by a series of sequential operating stations. At one of these stations, the lower web 32 of semi-rigid plastic sheet is secured to the sides of each die in succession, and is formed by known heat and pressure techniques into the round cup shape of the die cavities. (Note: conventionally each die 30 has two side-by-side cavities to form two identical cups simultaneously, although only one cavity is shown in the drawings.) Subsequently, the upper semi-rigid plastic web 34 is applied over the formed cups and the die thereafter carries both webs into a preliminary sealing stage 36. In this stage, the top web is heat-sealed to the marginal portions of the formed cup, by the heat-seal bars 38 carried by the reciprocally-operated clamp 40, in the manner taught in U.S. Pat. No. 3,061,984.

The heated portions of this clamp 40 include inclined wall segments 42 which extend in a circular pattern above the side walls of each formed cup. During the preliminary sealing operation, the interior of the clamp is evacuated above the top web 34, to draw this web up into contact with the heated segments 42. Within the circular region bounded by the segments 42 are insulating discs 44 which are maintained at a low temperature relative to the surrounding segments. These discs engage the plastic web 34, limiting its upward movement so as to prevent undue stretching thereof by the applied vacuum, and to assure that the heat is restricted to the localized region of the web immediately above the walls of each cup 10.

Prior to the next indexing movement, the vacuum is vented from above the web 34, and the clamp 40 is lifted up away from the die 30. The die then is shifted to the final seal station 48 which includes a sealing head 50 mounted with clamp 40 for simultaneous reciprocating action. This sealing head is formed on its lower surface with a recess containing a pair of side-by-side plugs 52 aligned with the cavities in die 30. When the sealing head comes down into position against the die (as shown), these plugs stretchform the heated top web 34 down into the cup 10 towards engagement with the product 12. The stretching of the top web is restricted primarily to the heated areas thereof, i.e. the circular bands immediately above the walls of the cup.

After the sealing head 50 has seated completely down against the die, the evacuation cycle is initiated. As described in U.S. Pat. No. 3,061,984, each die carries a reciprocable web-lifter (not shown herein) centrally located between the two side-by-side die cavities. This web-lifter is shifted up through an evacuation slit in the lower web 32 to lift the central part of the upper web 34 away from the lower web to form an evacuation channel into the interior of the cups. Vacuum then is applied to the region beneath the evacuation slit to exhaust substantially all of the air from the interior of both cups. This same vacuum is applied to the outer surfaces of the packages then in the die, to prevent any large differential pressure from being developed across the plastic sheet material.

To make gas-filled packages, the web-lifter preferably is constructed with an internal conduit (see U.S. Pat. No. 3,061,984) leading from a valved gas line up to the top of the web-lifter. After evacuation is complete, the gas line is valved open and gas flows into the interior of the cups through the channel established between the upper and lower webs 34 and 32. When the correct amount of gas pressure has been established, preferably somewhat below atmospheric, the gas line is valved off, and the web-lifter is shifted down to its normal position. Thereafter, a heated sealing bar descends from the sealing head 50 to heat-seal the upper web to the lower web at the evacuation slit, i.e. along the line between the two side-by-side cups. This heat seal, together with the peripheral heat seal made in the preceding station, completes the hermetic sealing of both packages in the die.

Just prior to the next indexing step, the interior of the sealing head 50 is vented to atmosphere. The resulting pressure on the still-heated top web 34 fully stretches this web down into each cup 10, forming the vertical to walls 22 which are pressed tightly against the side walls of the cup. Such further stretching of the top web is most effective when making vacuum packages, rather than gas-filled packages, because the maximum differential pressure will be developed across the plastic sheet material. In any event, the central portion 20 of the top is pressed against the product 12 so that, when the web 34 cools, this central portion will continue to hold the product gripped in position firmly against the bottom of the cup, without any significant distorting stresses being applied to the walls of the cup by the stretched top. It is advantageous, when carrying out the sequence of steps described, to maintain vacuum within the die 30, and below the cup 10, until after the space within the sealing head 50 is vented.

Figure 5:
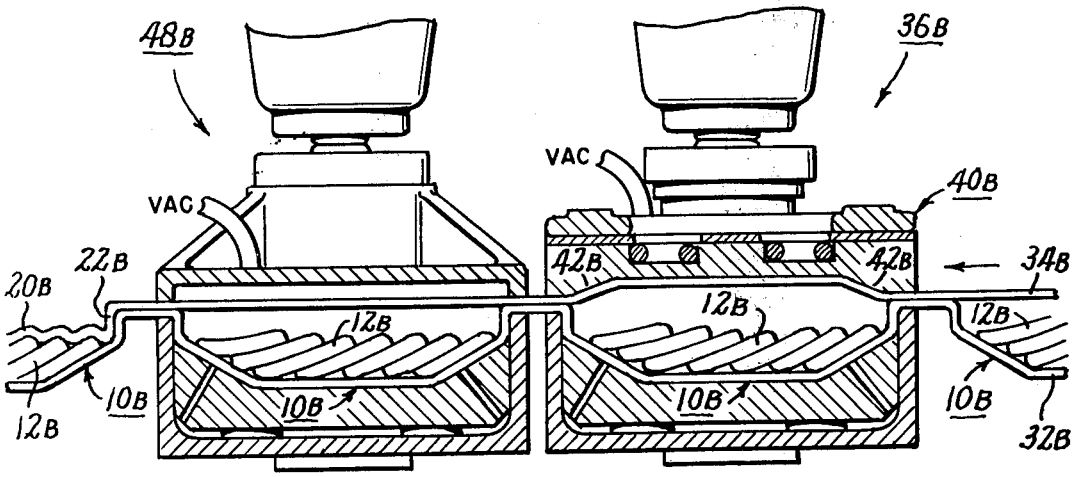
FIG. 5 is a vertical longitudinal section showing a portion of another automatic packaging machine suited for making packages as shown in FIG. 3.

For packaging products which do not have a flat upper surface, the top web must be formed to match the contour of the product. This can be accomplished, as shown in FIG. 5, by using in the preliminary seal station 36B a clamp 40B having heated segments 42B arranged to engage all of the top web 34B within the margins of the corresponding cup 10B. Thus the central portion of the top web is heated to forming temperature, as well as the side portions just inside the heat-seal line at the margins of the cup.

The evacuation and final seal stage 48B is generally like that of FIG. 4, except that there is no pre-forming plug. Instead, the entire forming function is effected by atmospheric pressure after venting. Since all of the top web was heated in the preceding stage, the atmospheric pressure forms the central top 20B to fit the contours of the product 12B as shown in the position immediately following the final seal stage 48B.

Figure 6:
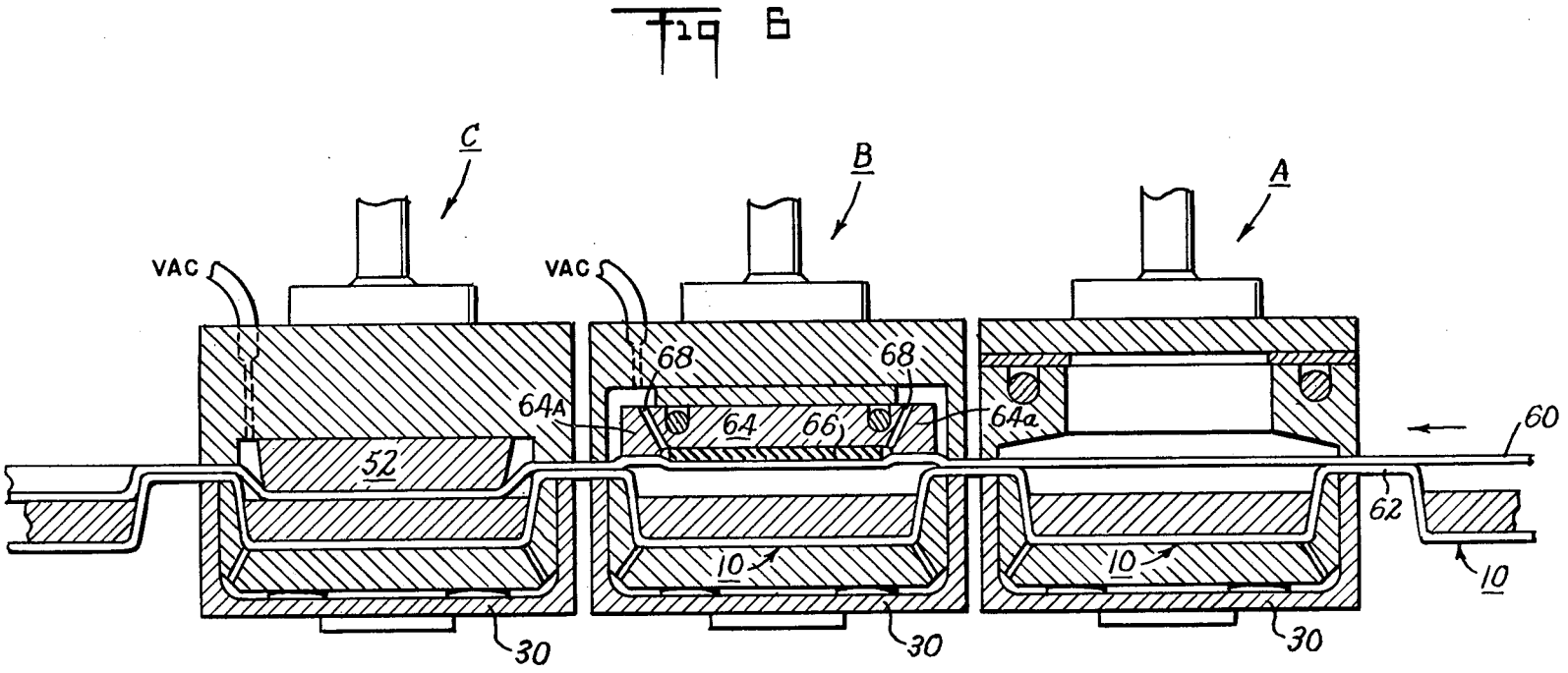
FIG. 6 is a vertical longitudinal section showing still another arrangement of packaging apparatus.

For some applications, e.g. where the stretch-forming of the top web is particularly difficult to achieve to the required degree, it may be desirable to use a three-stage top-forming arrangement as shown in FIG. 6. In this arrangement, the first stage A makes a preliminary seal of the two webs 60 and 62 entirely around the periphery of the two cups 10 in the die 30. Thus this stage is essentially like the preliminary seal stage in prior machines.

The next stage B, however, is provided solely for heating the top web 60 to its forming temperature, thereby ensuring close and precise control over this heating operation. As before, vacuum is applied above the top web to raise it up into contact with a heated element 64. For products having a flat upper surface (as shown in FIG. 6), only the peripheral regions of the top web should be heated. Thus an insulating disc 66 is provided to engage the central portions of the web, while the peripheral regions contact the hot outer band 64A beyond the vacuum conduits 68. For products having a non-flat top surface, the entire area of the top web must be heated to forming temperature.

The pre-heated top web then is moved to the evacuation and final seal stage C. In this stage, the heated web is forced down by pre-forming plug 52, and final forming of the top is effected by atmospheric pressure, as described with respect to FIG. 4.

One of the important characteristics of packages in accordance with the present invention is the capability of providing positive reclosure. That is, after the package has been opened and a part of the product removed, the top can be reclosed and automatically held in place mechanically by positive gripping means. FIGS. 7–15 illustrate various package configurations with this feature.

Figure 7:
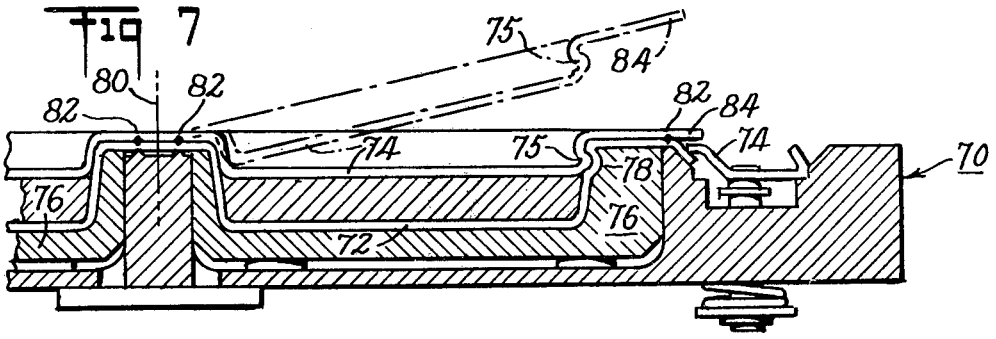
FIG. 7 is a vertical cross-section showing part of a packaging die having a special contour for setting the configuration of both the bottom and top webs.

FIG. 7 shows a forming die 70 of the type adapted for use with a packaging machine of the general type shown in U.S. Pat. No. 3,061,984. This die has two side-by-side cavities within which semi-rigid cups 72 may be formed and covered with a semi-rigid top 74 as described above. The die 70 includes recessed spring-loaded clamps 74 to grip the side margins of the bottom web, as taught in U.S. Pat. No. 3,438,175.

Each die cavity contains a die filler 76 the outboard wall of which is formed with a surface irregularity consisting, in this embodiment, of a horizontal groove-like re-entrant recess 78 just below the top surface of the die and extending nearly the full length of the wall. When the heated bottom web 72 is drawn into the die by vacuum, the plastic sheet material is pressed into this recess to form a mating groove in the inner side wall of the cup. Similarly, when the top web is subsequently stretch-formed into the cup (as described above), the plastic sheet material is forced into the cup groove to form a mating ridge 75.

After evacuation and final sealing, the two side-by-side packages in each die are separated at the center line 80, between the outer heat seals 82. Subsequently, the customer may open the package by lifting up the marginal outboard edge 84 of the top 74, to break the heat seal 82 along that one side, and along the adjoining sides perpendicular to that one side. The top will pivot (as shown in interrupted outline) about the heat-seal at the remaining side which thus will be the hinge side for the top. For some applications, the packaging apparatus may be arranged to score or thin the plastic sheet along the intended hinge line, as by striking the sheet with a heated bar, to enhance the hinge action.

After a portion of the product has been removed from the cup 72, the top 74 may be pivoted back down to its closed position. In that position, the ridge 75 re-enters the corresponding groove-like recess 78 in the cup wall, and serves as a detent to hold the top in place.

Figure 8:
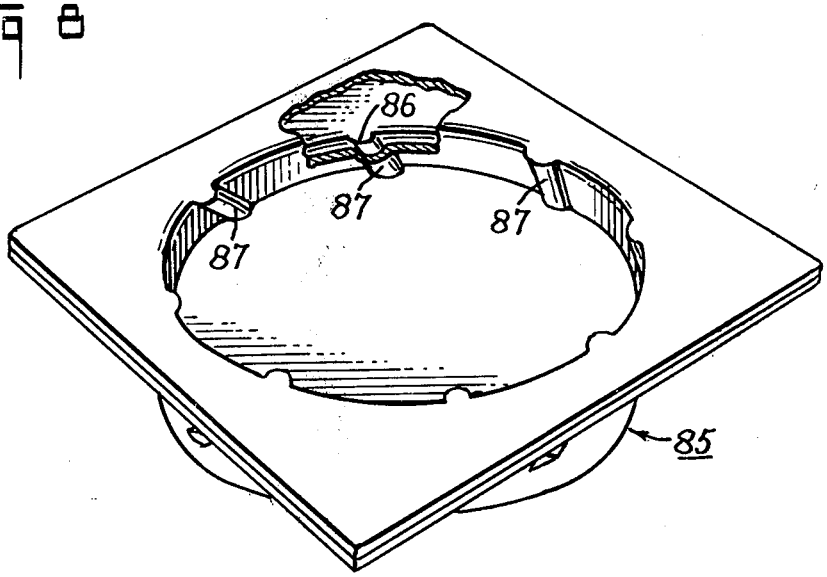
FIGS. 8 through 14 are views showing various package embodiments with positive reclosure characteristics.

An alternative detent arrangement for positive reclosure is shown in FIG. 8. Here the side wall of a round cup 85 is formed on its inner surface with spaced angulated ridges 86. These ridges engage mating groove-like surfaces of correspondingly angulated elements 87 in the side wall of the top. Because ridges 86 and elements 87 are inclined at an angle to the vertical in the nature of a helical screw-thread configuration, the top may easily be removed by a twist-off movement. After the package has been opened, it may readily be reclosed by a reverse twisting action. The angles and lengths of the helical grooves may be altered as required to set the desired degree of rotation for engaging and disengaging the top.

The package of FIG. 8 may be formed by a die like that of FIG. 7, but modified to provide the cavity walls (e.g. the side walls of a die filler) with protruding ridges similar in appearance to the top elements 87. Thus the heated bottom web will be formed about the die ridges to make the inwardly-extending ridges 86, and thereafter the heated top web will be formed about the ridges 86 to produce the mating groove-like recesses in the side wall of the top.

Figure 9:
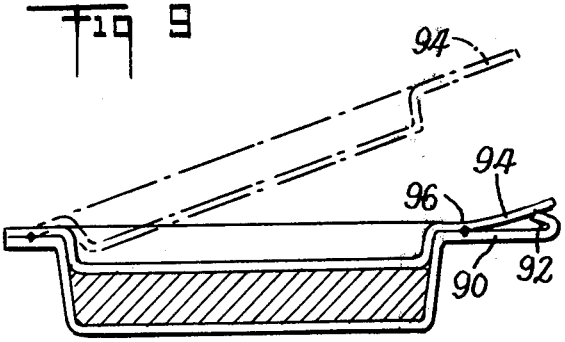

A positive reclosure can also be obtained by clip arrangements formed in the marginal areas of the top and bottom webs. Referring first to FIG. 9, the cup can be formed with an extended side margin 90, the end of which is permanently bent back on itself through approximately 180° to form a pocket 92. The top web is provided with a side margin 94 which extends out over the pocket 92, and is heat-sealed to the lower web at a position 96 close to the cup.

Figure 10:
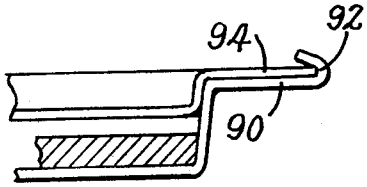

The package of FIG. 9 can readily be opened by peeling the top away from the cup, breaking the heat seal 96, as well as the heat seals along the sides of the cup which are perpendicular to the heat-seal 96. The top will pivot about the far side of the cup, as indicated in broken outline. The package thereafter can be reclosed by bowing the top slightly so as to slip the top margin 94 into the pocket 92, as shown in FIG. 10. It may be noted that the pocket 92 can readily be formed on automatic packaging machines by various known techniques, such as by applying a heated bar to the side margin 90 near the outside edge thereof, and then bending the edge up about the heated area by a reciprocable bar or the like.

Figure 11:
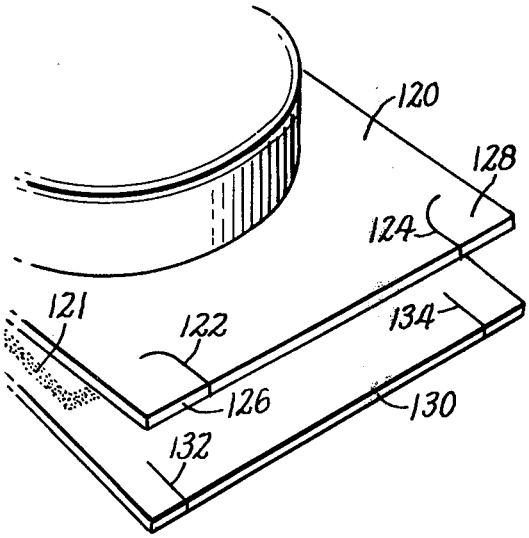
Figure 12:
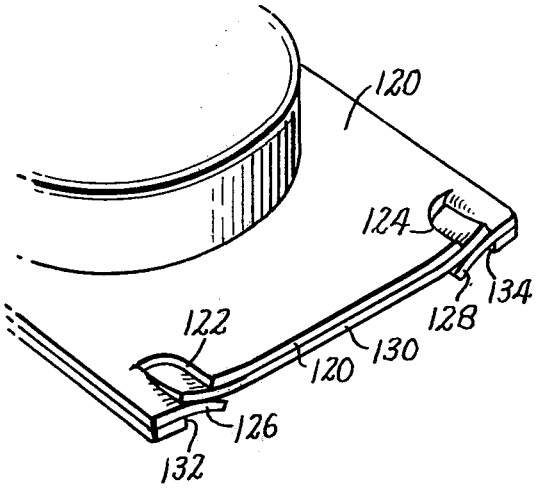

FIGS. 11 and 12 show another embodiment providing interference clips for positive reclosure. In this embodiment, the cup flange 120 is cut through in two places 122 and 124 to form the outlines of corresponding corner tabs 126 and 128. The adjacent marginal flange 130 of the package top is cut through in two places 132 and 134 to form straight slits just beneath the tabs 126 and 128. These lancing operations can conveniently be performed just prior to application of the respective web to the travelling die, as by means of automatic cutting tools immediately adjacent the packaging machine.

The package of FIG. 11 is completed and sealed in the usual fashion, described above. (Note: The cup and the top are shown spaced from one another in FIG. 11 only for illustrative purposes, and of course will be heat-sealed together around the cup mouth, as indicated by dotted line 121.) The package may be opened by peeling the two sealed flanges 120 and 130 apart, pivoting the top about the opposite side, i.e. the side not shown in the drawing. To close the package, the two flanges 120 and 130 are brought back together, and the tabs 126 and 128 pushed through the slits 132 and 134, as shown in FIG. 12. This can readily be done simply by bending the corners of the package downward.

Figure 13:
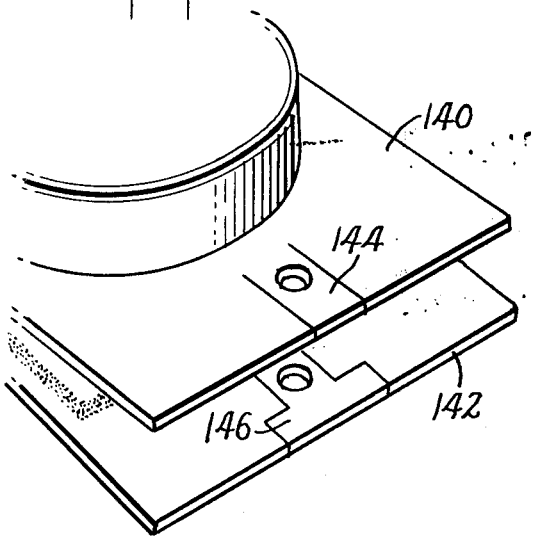
Figure 14:
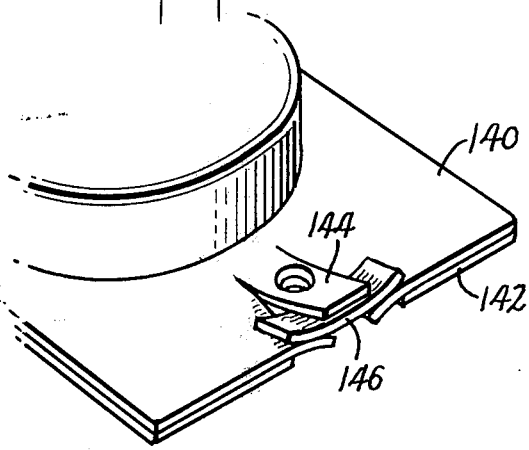

FIGS. 13 and 14 show a still further embodiment, where the cup and top flanges 140 and 142 are lanced to form the outlines of differently-shaped tabs 144 and 146. The package is otherwise formed and sealed in the usual way. After opening, by peeling the two flanges apart, the package may be reclosed positively by pushing the bottom tab 146 up through the side slits of the top tab 144. The natural resilience of the plastic material will accommodate this reclosure operation.

We claim:

1. The method of packaging food products and the like, comprising the steps of:

forming a first sheet of semi-rigid plastic material so as to develop a generally cup-shaped receptacle having a flange around the mouth thereof;

placing in the formed receptacle cup a product having less depth than the cup, thereby providing at least a moderate amount of space between the top of the product and the mouth of the cup;

advancing a second sheet of semi-rigid plastic material to said receptacle to provide a top therefor, said second sheet comprising material presenting a sealing surface to lie against said flange;

heating at least a selected part of said second sheet interiorly of said sealing surface to forming temperature;

applying pressure to said second sheet while still hot so as to stretch the heated part of the plastic material to form an inwardly-extending semi-rigid portion which in the completed package will engage the packaged product and hold it pressed against the bottom of the cup; and subsequent to said application of pressure to said heated part, evacuating the interior of said receptacle and hermetically sealing said top to said receptacle so as to develop an evacuated package;

the semi-rigid characteristic of said inwardly-extending portion maintaining a firm pressure on the product after the plastic has cooled.

2. The method of claim 1, wherein the pressure applied to said second sheet is effective to force the stretched portions of plastic outwardly into tight engagement with the inner surfaces of the side walls of the receptacle cup.

3. The method of claim 1, including the additional step of introducing an inert gas into the package, prior to hermetic sealing thereof, at a pressure significantly above the pressure level of evacuation.

4. The method of claim 1, wherein the top is formed inwardly initially by the mechanical force of a plug pressed against the top surface, and thereafter is further formed inwardly against the product by the force of atmospheric pressure.

5. The method of claim 1, wherein the heat applied to the second sheet is restricted to a localized band immediately above the side walls of the receptacle cup, whereby the stretching of the second sheet is limited effectively to that region, without significant stretching of the central portion of the top.

6. The method of claim 1, wherein the upper surface of the product is non-flat in profile, and wherein heat is applied to the entire region of the second sheet within the boundaries defined by the side walls of the receptacle cup; the force of atmospheric pressure causing the heated top to conform closely to the contour of the upper surface of the product.

7. The method of packaging products comprising the steps of:

advancing a first continuous sheet of semi-rigid plastic material along a path through a series of stations where packaging operations are performed;

stretch-forming said first sheet so as to develop, sequentially, a series of generally cup-shaped receptacles disposed along the direction of movement of said sheet, each receptacle having a flange around the mouth thereof in the plane of said first sheet of material;

placing in the formed receptacle cups products having less depth than the cups, thereby providing space between the top surfaces of the product and the plane of the sheet of material;

advancing a second sheet of semi-rigid plastic material in synchronism with said first sheet and along a path which contiguously joins the path of said first sheet whereby the flange surfaces of said first sheet are next to matching sealing surfaces of said second sheet when each receptacle cup is within the region of joinder of said paths;

heating at least selected parts of said second sheet interiorly of said sealing surfaces to prepare for stretch-forming thereof;

applying pressure to said heated parts in sequential order to stretch the material so as to form a series of extended semi-rigid portions each arranged to protrude into the mouth of a corresponding receptacle cup so that in the completed packages said semi-rigid portions will engage the tops of the products to hold the products pressed tightly against the bottoms of the cups; and at some stage of the process, and while said receptacle cups remain unsevered from said first sheet of material, pressing said flanges and sealing surfaces tightly together between an opposed set of heat-sealing elements defining a sealing line aligned with said first and second paths where they come together contiguously in said region of joinder, said flanges being maintained fixed in position in the line of the path of movement of said first sheet of material as the receptacles are being sealed to said sealing surfaces of said second sheet of material, thus avoiding any movement of the receptacles toward said second sheet of material for the purpose of effecting a seal therebetween.

8. The method of vacuum packaging products comprising the steps of:

forming a first sheet of semi-rigid plastic material so as to develop a generally cup-shaped receptacle having a flange around the mouth thereof;

placing in said cup a product having less depth than the cup;

advancing a second sheet of semi-rigid plastic material to said receptacle as a top therefor, said second sheet comprising material providing sealing surfaces adapted to lie against said flange to be sealed thereto;

heating at least a selected part of said second sheet interiorly of said sealing surfaces;

applying pressure to said heated part to form a semi-rigid top portion which in the completed package protrudes into the cup mouth to engage the product and hold it mechanically pressed against the cup bottom by virtue of the rigidity of the inwardly protruding portion;

subsequent to said application of pressure, evacuating the interior spaces of the package which is defined by said receptacle cup and said top positioned thereover with said sealing surfaces next to said flange and said top portion protruding into said cup mouth towards said product; and thereafter hermetically sealing said top to said receptacle cup to maintain the vacuum in said package, whereby atmospheric pressure tends to help force said inwardly protruding semi-rigid top portion against said product.

9. The method of vacuum packaging products comprising the steps of:

forming a first sheet of semi-rigid plastic material so as to develop a generally cup-shaped receptacle having a flange around the mouth thereof;

placing in said cup a product having less depth than the cup;

advancing a second sheet of semi-rigid plastic material to said receptacle as a top therefor, said second sheet comprising material providing sealing surfaces adapted to lie against said flange to be sealed thereto;

heating at least a selected part of said second sheet interiorly of said sealing surfaces;

applying pressure to said heated part to form a semi-rigid top portion which in the completed package will protrude inwardly into the cup mouth to rigidly engage the product and hold it pressed against the cup bottom;

subsequent to said application of pressure to said heated part, isolating said cup and top from atmosphere by positioning said cup and top together in sealed chamber means;

evacuating said chamber means and the interior spaces of the package defined by said cup and top; and thereafter hermetically sealing said top to said receptacle cup to maintain the vacuum therein after venting of said chamber means, the force of atmospheric pressure upon venting of said chamber means serving to help press said protruding semi-rigid top portion tightly against said product.

10. Packaging apparatus for making vacuum or gas-filled packages, comprising:

first and second packaging stations;

conveyor means for carrying a series of flanged cups into said second station;

means to supply a web of packaging material for movement through said first and second station with said web being positioned over said cups in said second station to serve as closure tops therefor to define a package;

heating means in said first station for supplying heat to said web of packaging material in preselected areas thereof to soften said web for subsequent stretch-forming in said second station;

vacuum means comprising a vacuum chamber at said second station operable from open condition to closed condition to evacuate said packages;

plug means in said second station operable to be forced against said heated web to stretch-form that web down into the interior of the corresponding cup; and means to apply fluid pressure to said web to complete the formation of said closure top.

11. Apparatus as claimed in claim 10, wherein said means to apply fluid pressure comprises means to vent the portion of said vacuum chamber above said web.

12. Apparatus as claimed in claim 11, wherein said vent means is operable while said plug means is maintained in position holding said closure top stretched down into the cup.

13. Apparatus as claimed in claim 10, wherein said vacuum means is operable to begin evacuation of said package after the actuation of said plug means to stretch-form said closure top down into said cup.

14. For making vacuum or gas-filled packages of the type wherein a film of packaging material, sealed to a flanged cup of packaging material containing the product, is stretched to extend into the cup in telescoping fashion to tightly grip the product within the cup; the improved process comprising the following steps:

heating the film in regions thereof to be stretched into the cup;

placing the heated film and the cup in a vacuum chamber with the film overlying the cup flanges and the cup mouth to define a complete package;

moving a plug against said film while it is still hot, to stretch-form the film down into the cup to a position at least close to the cupper surface of the product therein;

at respective stages of said process, evacuating said chamber and the interior of said package, and sealing said package material to provide a complete hermetic seal of said package; and applying fluid pressure to said film to press said film tightly against the product in said cup.

15. The process of claim 14, wherein said plug is moved against said film prior to the hermetic sealing of said package.

16. The process of claim 14, wherein said plug movement occurs prior to start of evacuation of the package.

17. The process of claim 14, wherein said fluid pressure is developed by venting said vacuum chamber.

18. The process of claim 14, including the step of admitting gas into the package prior to hermetic sealing thereof.

19. For making vacuum or gas-filled packages of the type wherein a film of packaging material is sealed to a flanged cup and is stretched down into the cup to press against the cup side walls and product therein, the improved process comprising:

positioning the film over the cup;

moving a plug against the film to stretch it down into the cup at least substantially adjacent the product; and applying fluid pressure to the film while it is pressed by said plug, the composite force of said plug and said fluid pressure serving to press said fluid against the product in the cup; and at some stage in the process, hermetically sealing said film to said cup.

* * * * *